US009964305B1

(12) United States Patent
Brady

(10) Patent No.: US 9,964,305 B1
(45) Date of Patent: May 8, 2018

(54) CAMPFIRE LIGHTER

(71) Applicant: Peter Brady, Lowell, IN (US)

(72) Inventor: Peter Brady, Lowell, IN (US)

( * ) Notice: Subject to any disclaimer, the term of this patent is extended or adjusted under 35 U.S.C. 154(b) by 260 days.

(21) Appl. No.: 15/000,121

(22) Filed: Jan. 19, 2016

(51) Int. Cl.
*F23Q 2/16* (2006.01)
*F23Q 2/28* (2006.01)
*F23Q 3/01* (2006.01)

(52) U.S. Cl.
CPC ..... *F23Q 2/285* (2013.01); *F23Q 3/01* (2013.01)

(58) Field of Classification Search
USPC ..... 431/344, 345, 350
See application file for complete search history.

(56) References Cited

U.S. PATENT DOCUMENTS 3,850,374 A 11/1974 Snoddy
4,222,734 A 9/1980 Nolf
4,253,820 A 3/1981 Jarreau
4,315,731 A 2/1982 Moore
6,428,309 B1 8/2002 Doiron
D464,848 S 10/2002 Chevalier
6,648,630 B2 11/2003 Tse
6,926,519 B1 8/2005 Lusson
7,563,094 B2 7/2009 Yang
2006/0102108 A1* 5/2006 Panasik ..... B25C 1/08 123/41.31
2006/0121401 A1* 6/2006 Angevine ..... F23Q 2/16 431/344

FOREIGN PATENT DOCUMENTS

CN 203010667 6/2013

* cited by examiner

*Primary Examiner* — Avinash Savani
(74) *Attorney, Agent, or Firm* — Kyle A. Fletcher, Esq.

(57) ABSTRACT

The campfire starter includes a first compartment that is connected to a flexible conduit that extends there from. The flexible conduit includes an igniter nozzle on a distal end, which dispenses a flame there from, and which is adapted to ignite a campfire. The first compartment is adapted to be handled, and from which the flexible conduit extends in order to position the igniter nozzle immediately adjacent the campfire. The flexible conduit is of an undefined length, and is made of a flexible material that enables curves and bends to be formed and adjusted as needed.

15 Claims, 4 Drawing Sheets

CAMPFIRE LIGHTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of lighting instruments, more specifically, a device that is specially designed to start a campfire.

SUMMARY OF INVENTION

The campfire starter includes a first compartment that is connected to a flexible conduit that extends therefrom. The flexible conduit includes an igniter nozzle on a distal end, which dispenses a flame there from, and which is adapted to ignite a campfire. The first compartment is adapted to be handled, and from which the flexible conduit extends in order to position the igniter nozzle immediately adjacent the campfire. The flexible conduit is of an undefined length, and is made of a flexible material that enables curves and bends to be formed and adjusted as needed.

These together with additional objects, features and advantages of the campfire starter will be readily apparent to those of ordinary skill in the art upon reading the following detailed description of the presently preferred, but nonetheless illustrative, embodiments when taken in conjunction with the accompanying drawings.

In this respect, before explaining the current embodiments of the campfire starter in detail, it is to be understood that the campfire starter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the campfire starter.

It is therefore important that the claims be regarded as including such equivalent construction insofar as they do not depart from the spirit and scope of the campfire starter. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
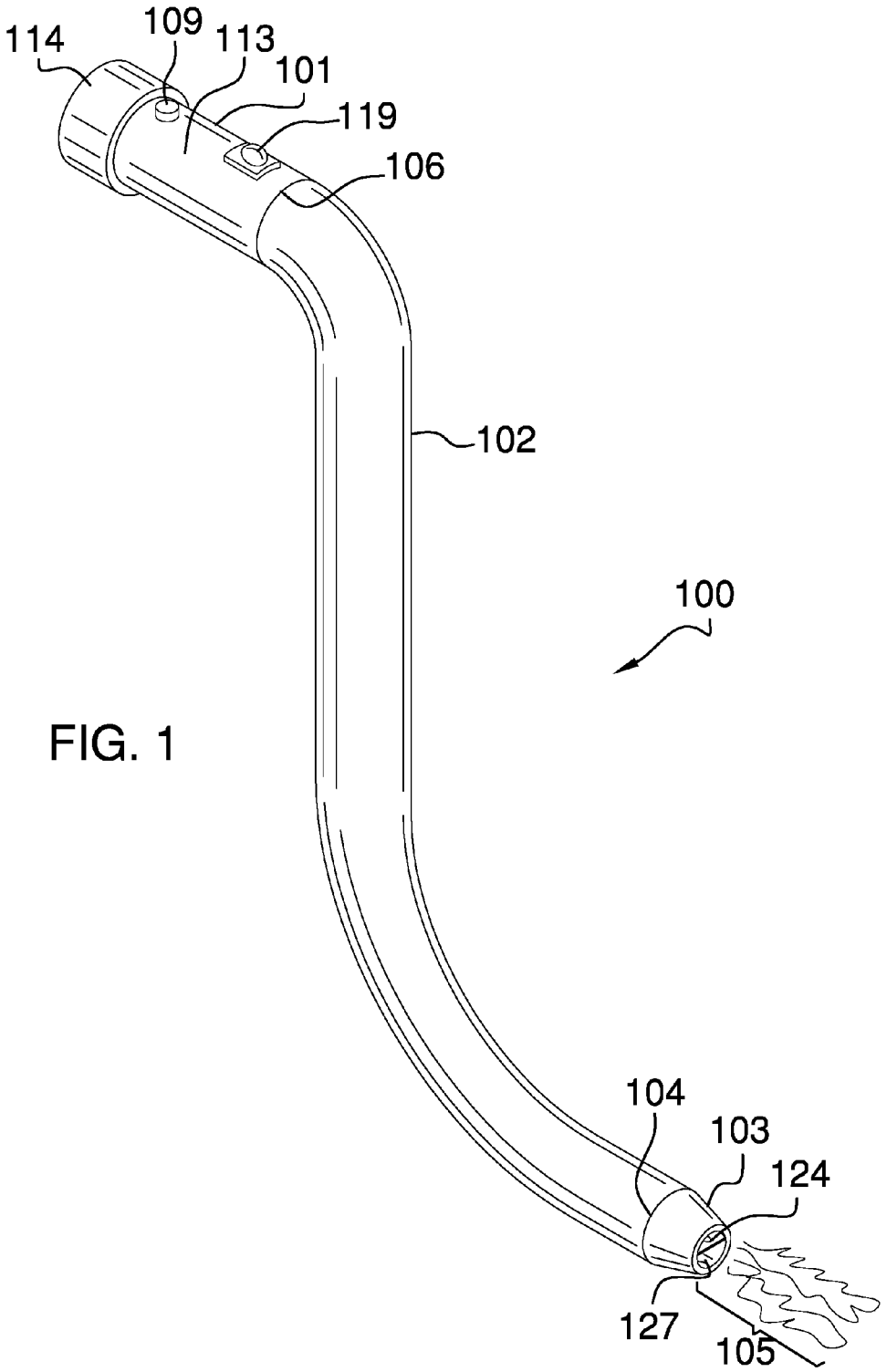
FIG. 1 is a perspective view of an embodiment of the disclosure.
Figure 2:
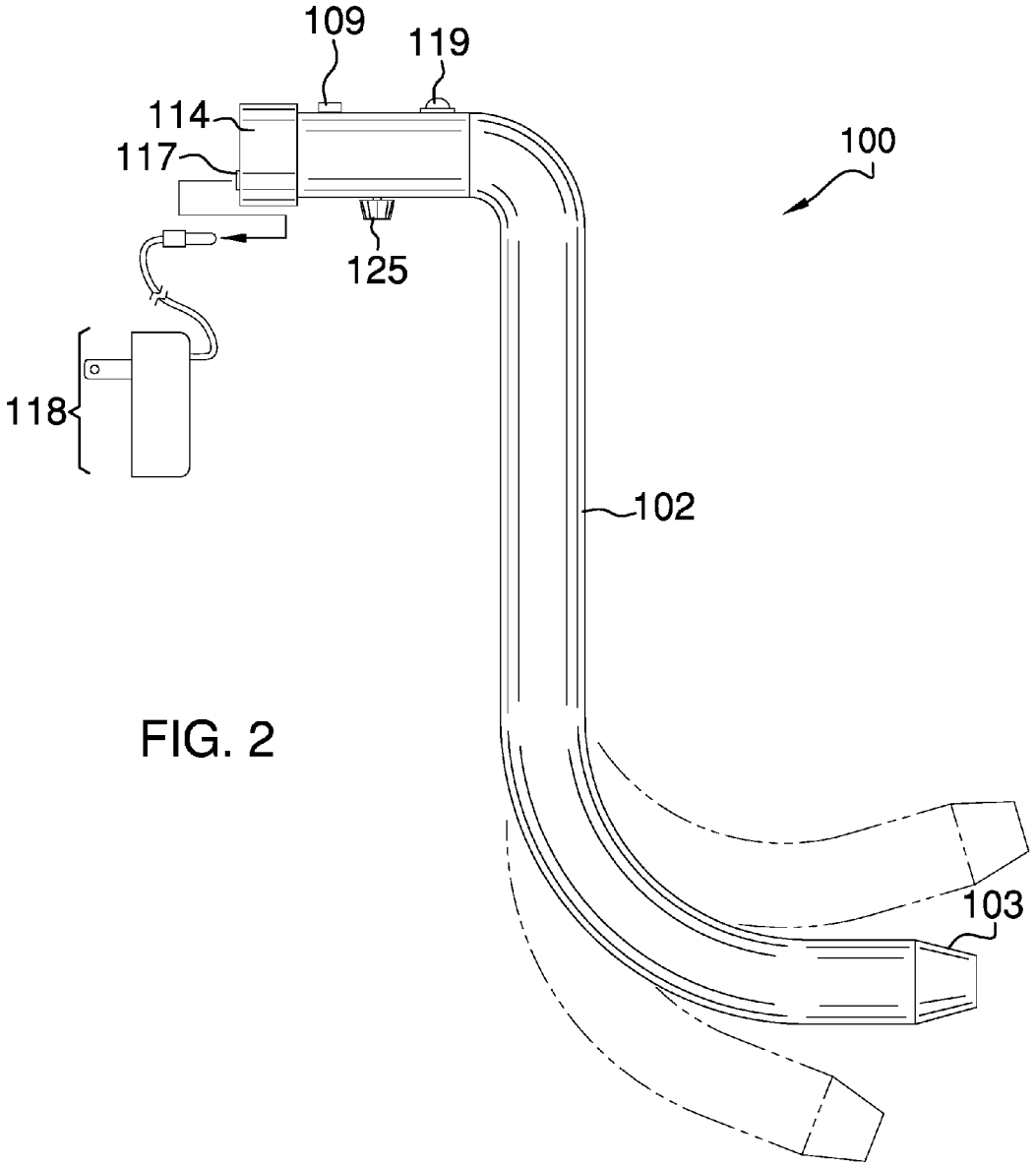
FIG. 2 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The campfire starter 100 (hereinafter invention) comprises a first compartment 101 that is connected to a flexible conduit 102 that extends therefrom. The flexible conduit includes an igniter nozzle 103 on a first distal end 104, which dispenses a flame 105 there from, and which is adapted to ignite a campfire 200.

The first compartment 101 is further defined with a second distal end 106. The flexible conduit 102 attaches to the first compartment 101 at the second distal end 106. The first compartment 101 is a hollowed cylinder that houses a lighter fluid reservoir 107 as well as a blower fan 108. The lighter fluid reservoir 107 includes a fill cap 109 that attaches onto a lighter fluid refill port 110 that is located on the first compartment 101. The blower fan 108 is located underneath the lighter fluid reservoir 107. The blower fan 108 is positioned between a blower intake duct 111 and a second blower duct 112. The blower intake duct 111 extends from an outer surface 113 of the first compartment 101 to blower fan 108, which then accelerates air down the second blower duct 112.

The first compartment 101 includes a battery compartment 114 that is located at a third distal end 115 of the first compartment 101. The battery compartment 114 houses at least one battery 116, which is responsible for supplying electricity for the invention 100. The battery compartment 114 includes a recharging port 117 that enables a power cord 118 to connect with and recharge the battery 116 contained therein.

The first compartment 101 includes an igniter button 119, which is located adjacent to the lighter fluid reservoir 107. The igniter button 119 as well as the blower fan 108 are in wired connection with the at least one battery 116. The igniter button 119 is accessible from the outer surface 113 of the first compartment 101. The igniter button 119 is also wired to an igniter wire 120. The igniter wire 120 extends from the igniter button 119 at the first compartment 101, along the flexible conduit 102, and to the igniter nozzle 103.

Figure 3:
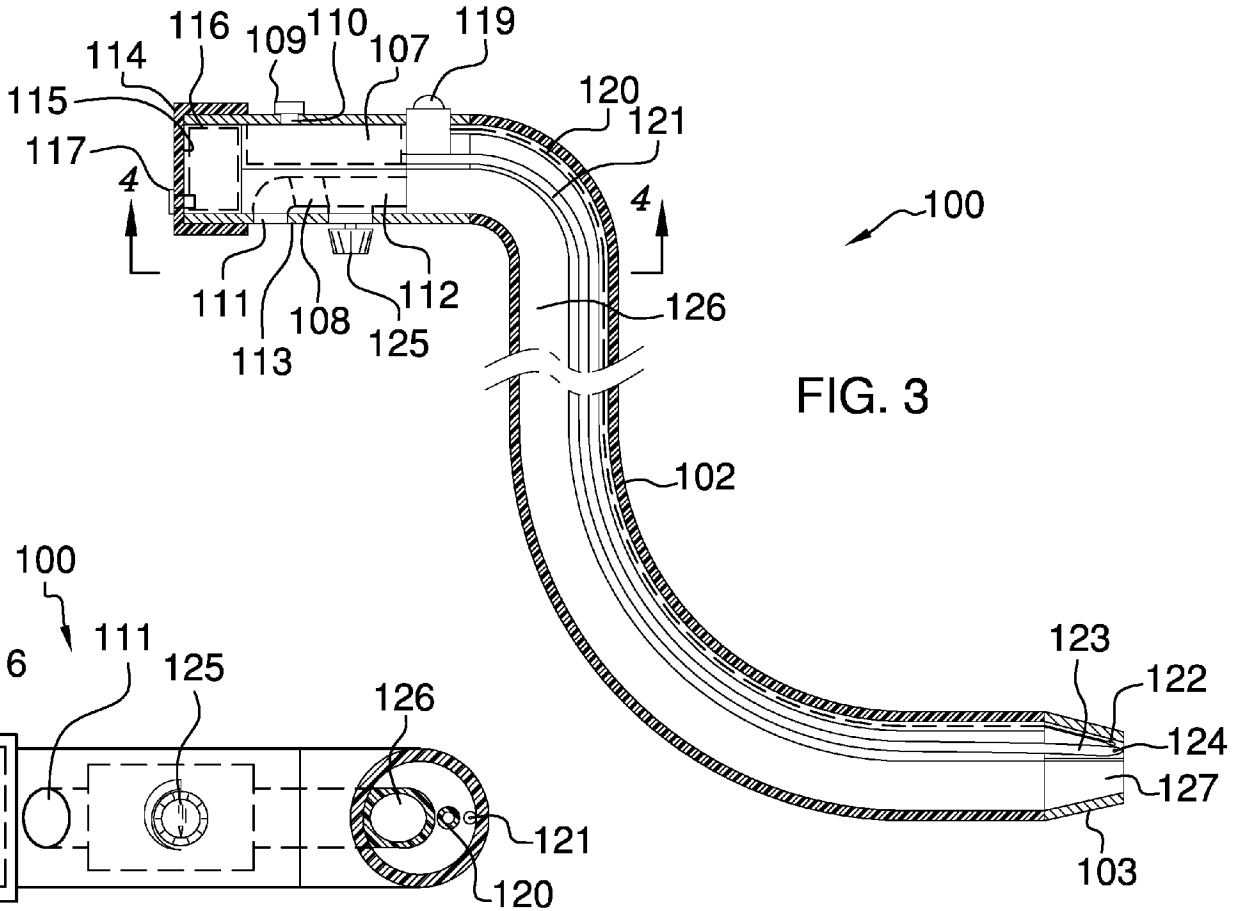
FIG. 3 is a cut-away view of an embodiment of the disclosure.
Figure 4:
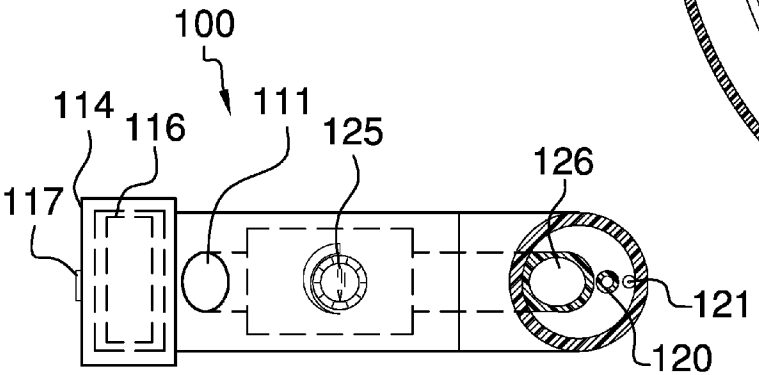
FIG. 4 is a cross-sectional view of an embodiment of the disclosure along line 4-4 in FIG. 3.
Figure 5:
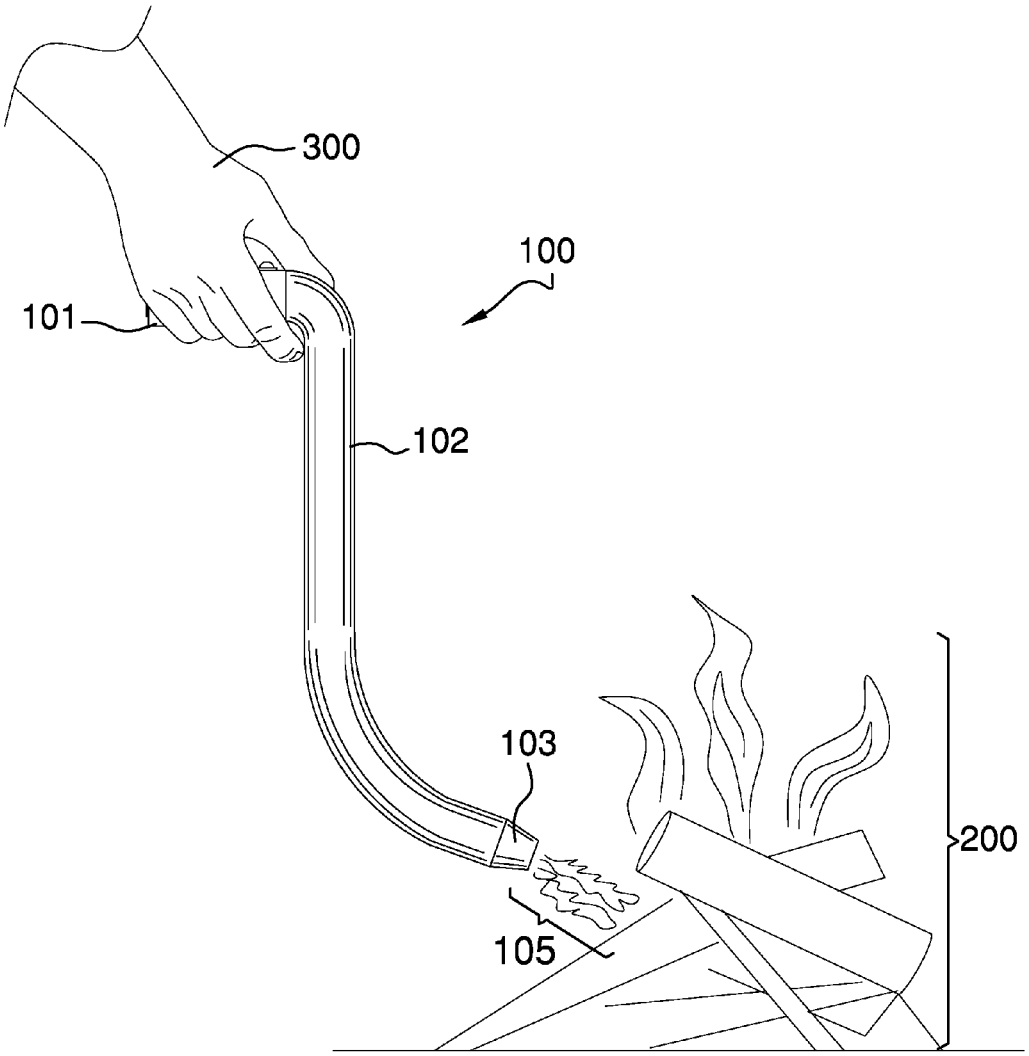
FIG. 5 is a view of an embodiment of the disclosure in use.

Referring to FIG. 3, the flexible conduit 102 includes a lighter fluid conduit 121 that connect to the lighter fluid reservoir 107. The lighter fluid conduit 121 extends along the flexible conduit 102 to the igniter nozzle 103. A lighter fluid nozzle 122 is located at the igniter nozzle 103. The lighter fluid nozzle 122 is in fluid connection with the lighter fluid conduit 121 such that lighter fluid is able to be dispensed from the lighter fluid reservoir 107 in the first compartment 101, along the flexible conduit 102 via the lighter fluid conduit 121, and where said lighter fluid is dispensed at the igniter nozzle 103 via the lighter fluid nozzle 122.

The igniter wire 120 extends down the flexible conduit 102, and to the igniter nozzle 103 where a spark igniter 123 is located. The spark igniter 123 along with the lighter fluid nozzle 122 is located at the igniter nozzle 103. Moreover, the spark igniter 123 is positioned immediately adjacent the lighter fluid nozzle 122. Both the lighter fluid nozzle 122 and the spark igniter 123 are positioned at a nozzle output 124 provided at the igniter nozzle 103.

The blower fan 108 is wired to an on/off button 125 that is accessible on the outer surface 113 of the first compartment 101. The on/off button 125 is wired to the at least one battery 116. The on/off button 125 may be further defined as a voltmeter that includes a rotation knob that adjusts the electricity provided to the blower fan 108 thereby providing a speed adjustment capability to the blower fan 108.

The blower fan 108 moves air down the second conduit 112, and into a third conduit 126. The third conduit 126 extends along the flexible conduit 102. The third conduit 126 is separate and distinct from the lighter fluid conduit 121. The third conduit 126 connects with a blower nozzle 127 provided on the igniter nozzle 103. The blower nozzle 127 dispenses accelerated air adjacent the nozzle output 124 such that the flame 105 is directed away from the igniter nozzle 103.

In use, the invention 100 is manually grasped via an end user 300 at the first compartment 101. The flexible conduit 102 extends away from and downwardly with respect to the first compartment 101, and such that the igniter nozzle 103 is adapted to be positioned immediately adjacent the campfire 200 in order to start and ignite the campfire 200.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved inventions, yet all of which will fall within the spirit and scope of the present invention as defined in the following claims. Accordingly, the invention is to be limited only by the scope of the following claims and their equivalents.

The inventor claims:

1. A campfire starter comprising:

a first compartment that is adapted to be manually grasped via an end user;

wherein a flexible conduit extends from the first compartment downwardly and away from the first compartment;

wherein an igniter nozzle is located on a first distal end of the flexible conduit;

wherein the igniter nozzle dispenses a flame, and which is adapted to ignite a campfire;

wherein the first compartment is further defined with a second distal end;

wherein the flexible conduit attaches to the first compartment at the second distal end;

wherein the first compartment is a hollowed cylinder that houses a lighter fluid reservoir as well as a blower fan;

wherein the lighter fluid reservoir includes a fill cap that attaches onto a lighter fluid refill port that is located on the first compartment;

wherein the blower fan is located underneath the lighter fluid reservoir;

wherein the blower fan is positioned between a blower intake duct and a second blower duct;

wherein the blower intake duct extends from an outer surface of the first compartment to blower fan, which then accelerates air down the second blower duct.

2. The lighting fixture according to claim 1 wherein the first compartment includes a battery compartment that is located at a third distal end of the first compartment.

3. The lighting fixture according to claim 2 wherein the battery compartment houses at least one battery, which is responsible for supplying electricity.

4. The lighting fixture according to claim 3 wherein the battery compartment includes a recharging port that enables a power cord to connect with and recharge the battery contained therein.

5. The lighting fixture according to claim 4 wherein the first compartment includes an igniter button, which is located adjacent to the lighter fluid reservoir; wherein the igniter button as well as the blower fan are in wired connection with the at least one battery.

6. The lighting fixture according to claim 5 wherein the igniter button is accessible from the outer surface of the first compartment; wherein the igniter button is also wired to an igniter wire; wherein the igniter wire extends from the igniter button at the first compartment, along the flexible conduit, and to the igniter nozzle.

7. The lighting fixture according to claim 6 wherein the flexible conduit includes a lighter fluid conduit that connects to the lighter fluid reservoir.

8. The lighting fixture according to claim 7 wherein the lighter fluid conduit extends along the flexible conduit to the igniter nozzle; wherein a lighter fluid nozzle is located at the igniter nozzle.

9. The lighting fixture according to claim 8 wherein the lighter fluid nozzle is in fluid connection with the lighter fluid conduit such that lighter fluid is able to be dispensed from the lighter fluid reservoir in the first compartment, along the flexible conduit via the lighter fluid conduit, and where said lighter fluid is dispensed at the igniter nozzle via the lighter fluid nozzle.

10. The lighting fixture according to claim 9 wherein the igniter wire extends down the flexible conduit, and to the igniter nozzle where a spark igniter is located; wherein the spark igniter along with the lighter fluid nozzle is located at the igniter nozzle.

11. The lighting fixture according to claim 10 wherein the spark igniter is positioned immediately adjacent the lighter fluid nozzle; wherein both the lighter fluid nozzle and the spark igniter are positioned at a nozzle output provided at the igniter nozzle.

12. The lighting fixture according to claim 11 wherein the blower fan is wired to an on/off button that is accessible on the outer surface of the first compartment.

13. The lighting fixture according to claim 12 wherein the on/off button is wired to the at least one battery; wherein the on/off button is further defined as a voltmeter that adjusts the electricity provided to the blower fan thereby providing a speed adjustment capability to the blower fan.

14. The lighting fixture according to claim 13 wherein the blower fan moves air down the second conduit, and into a third conduit.

15. The lighting fixture according to claim 14 wherein the third conduit extends along the flexible conduit; wherein the third conduit is separate and distinct from the lighter fluid conduit; wherein the third conduit connects with a blower nozzle provided on the igniter nozzle; wherein the blower nozzle dispenses accelerated air adjacent the nozzle output such that the flame is directed away from the igniter nozzle.

* * * * *